US005454556A

United States Patent [19]

Siegel

[11] Patent Number: 5,454,556

[45] Date of Patent: Oct. 3, 1995

[54] CURL DETECTION THROUGH PNEUMATIC ACQUISITION SENSING

[75] Inventor: Robert P. Siegel, Penfield, N.Y.

[73] Assignee: Xerox Corporation, Stamford, Conn.

[21] Appl. No.: 178,167

[22] Filed: Jan. 6, 1994

[51] Int. Cl.[6] ..... B65H 3/48

[52] U.S. Cl. ..... 271/98; 271/99; 355/312

[58] Field of Search ..... 355/309, 308, 355/311–312; 271/10–11, 94, 18, 20, 90–91, 131, 132, 133, 152–155, 98–99

[56] References Cited

U.S. PATENT DOCUMENTS

| | | | |
|---|---|---|---|
| 4,235,431 | 11/1980 | Abrams et al. | 271/10 |
| 4,305,576 | 12/1981 | Hamlin | 271/11 |
| 4,411,417 | 10/1983 | Browne | 271/94 |
| 4,632,377 | 12/1986 | Browse | 271/9 |
| 4,638,986 | 1/1987 | Huggins et al. | 271/98 |
| 4,813,660 | 3/1989 | Dodd et al. | 271/11 |
| 4,887,805 | 12/1989 | Herbert et al. | 271/94 |
| 5,118,589 | 6/1992 | Aslam et al. | 430/124 |
| 5,176,373 | 1/1993 | Namba | 271/3.1 |
| 5,184,813 | 2/1993 | Schwitzky et al. | 71/98 |
| 5,270,778 | 12/1993 | Wyer | 355/311 |
| 5,275,393 | 1/1994 | Cromie | 271/98 |
| 5,344,133 | 9/1994 | Jantsch et al. | 271/94 |
| 5,356,127 | 10/1994 | Moore et al. | 271/11 |

*Primary Examiner*—A. T. Grimley
*Assistant Examiner*—T. A. Dang
*Attorney, Agent, or Firm*—William A. Henry, II

[57] ABSTRACT

A machine includes a scheme for detecting the level of curl in sheets in a stack by measuring the time it takes to acquire a sheet with a bottom corrugation vacuum feeder (BVCF). A vacuum switch changes state at a preset vacuum level thereby detecting any significant rise in vacuum which occurs when a sheet has been acquired by the BCVF. A digital control circuit senses the change of state which takes place in the vacuum switch and feeds a signal to the machine's microprocessor which in turn signals an air knife in the BVCF to increase or decrease air pressure toward the sheet stack to compensate for the stressed state of the sheets.

9 Claims, 4 Drawing Sheets

CURL DETECTION THROUGH PNEUMATIC ACQUISITION SENSING

BACKGROUND OF THE INVENTION

The present invention relates to sheet feeding and more particularly to a vacuum corrugation feeder with the capability of detecting the degree of curl in sheets.

With the advent of high speed xerographic copy reproduction machines where:in copies can be produce at a rate in excess of three thousand copies per hour, the need for a document and sheet feeder to, for example, feed documents to the platen of a copier in rapid succession in a reliable and dependable manner in order to utilize the full capabilities of the copier. A number of document handlers are currently available to fill that need. These document handlers must operate flawlessly to virtually eliminate the risk of damaging the original document and generate minimum machine shutdowns due to misfeeds or document multifeeds. It is in the initial separation of the individual documents from the document stack where the greatest number of problems occur which, in some cases, can be due to upcurl and downcurled in documents.

Since the documents must be handled gently but positively to assure separation without damage through a number of cycles, a number of solutions halve been suggested such as friction rolls or belts used for fairly positive document feeding in conjunction with a retard belt, pad, or roll to prevent multifeeds. Vacuum separators such a sniffer tubes, rocker type vacuum rolls, or vacuum feed belts have also been utilized.

While the friction roll-retard systems are very positive, the action of the retard member if it acts upon the printed face can cause smearing or partial erasure of the printed material on the document. With single sided documents, this does not present a problem as the separator can be designed so that the retard mechanism acts upon the underside of the document. However, with documents printed on both sides, there is no way to avoid the problem. Additionally, the reliable operation of friction retard feeders is highly dependent on the relative frictional properties of the paper being handled. This cannot be controlled in a document feeder.

Various approaches have been highly successful in answering the above problems, for example U.S. Pat. No. 4,305,576 discloses a typical vacuum separating and feeding system wherein a plurality of friction belts is arranged to run over a vacuum plenum placed at the bottom of a sheet supply tray which has a "U" shaped pocket formed in it. The pocket serves to provide space for the bottom sheet to be captured by the vacuum feed belt assembly, to provide an air seal between the bottom sheet and the edges of the pocket and to provide a high pressure seal between the bottom sheet and the remainder of the stack. This high pressure seal is achieved by supporting a major portion of the stack weight on the edge regions of the pocket. However, this "U" shaped configuration was found to not permit deformation of the sheet in a geometrically developable shape which results in a reduction in the degree of levitation of the sheet stack. The bottom sheet vacuum corrugation feeder in U.S. Pat. No. 4,411,417 answered this problem by including a differently designed stack support tray that has a planar base portion defining a base plane, the front of the base portion having a opening within which the bottom sheet separator is positioned. The tray also includes two sloping planar side wings, one at each side of the opening in the base portion. The sloping planar side wings are angled upward from the base plane and are angled outward from front to rear of the tray and intersect the base plane such that the intersection at the rear of the tray is in the approximate location of the rear corners of a rectangle the size of a sheet to be fed and the intersection of the planar wings and the base plane at the front of the tray is approximately midway between the front corners of a sheet to be fed and the center line of a sheet to be fed.

Even though the above two document handlers in U.S. Pat Nos. 4,305,576 and 4,411,417 have been highly successful, an improvement of the document feeder in U.S. Pat No 4,411,417 is still needed because of the presence of unpredictable curl in sheets which has been known to cause problems throughout the xerographic process. In present day intelligent paper handling devices, it is useful to know as much as possible about the qualities of the: paper which is passing through a machine. Various parameters such as timing, airflow, normal force and velocity can be adjusted to compensate for the presence of detectable levels of input stress, such as, sheet curl to ensure that the paper will arrive safely and in time to meet the interface requirements of the various subsystems of the machine. Copy quality parameters, such as, transfer or detack current, as well as, fuser and decurler settings can also benefit from this information.

SUMMARY OF THE INVENTION

Accordingly, in an aspect of this invention, a means of detecting the level of curl is disclosed by means of measuring the time it takes to acquire the sheet with a vacuum feeder. The acquisition time for capture of a sheet by the vacuum feeder is measured by use of a low cost pressure switch that changes state depending upon the degree of vacuum behind feeder belt holes and a timer. The timer value at the point that the pressure switch changes state and basis weight of the sheet are compared to a lookup table to yield the curl level of the sheet.

BRIEF DESCRIPTION OF THE DRAWINGS

The foregoing and other features of the instant invention will be apparent from a further reading of the specification, claims and from the drawings in which:

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

The invention will now be described by reference to a preferred embodiment of the bottom vacuum corrugation feeder apparatus for a copier/printer in FIG. 2. However, it should be understood that the curl detection method and apparatus of the present invention could be used with a top vacuum corrugation feeder or vacuum feeders in general.

Figure 1:
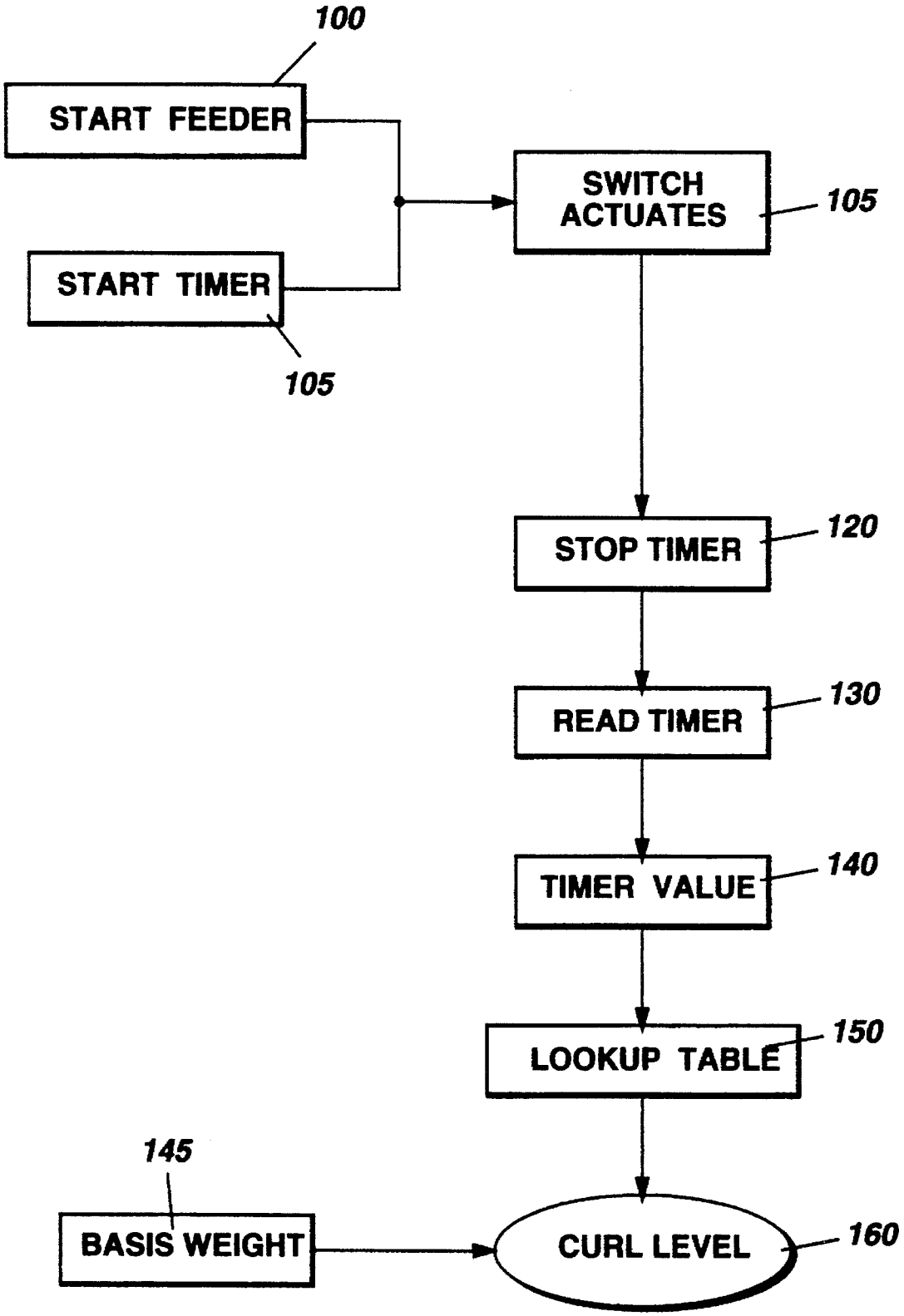
FIG. 1 is a flow chart showing sheet curl determination in accordance with the present invention.

In general, the amount of curl in sheets can be determined in accordance with the present invention as shown in the flow diagram of FIG. 1 which illustrates the sequence of operation of a vacuum feeder in determining the curl level in sheets fed from the vacuum feeder. The vacuum feeder includes a vacuum plenum onto which sheets are drawn and forwarded out of the feeder for further processing. The feeder is started in block 100 and simultaneously a timer 105 is started in block 105. Once a sheet is drawn against the vacuum plenum in the the vacuum feeder, a pressure switch is actuated in block 110. Actuation of the pressure switch stops the timer in block 120 and the time it took for the sheet to be drawn to the vacuum plenum is read in block 130. This timer value is shown in block 140 and is sent along with the basis weight in block 145 of the sheet to lookup table 150 where a comparison of the input data is made with curl amounts that are contained in the lookup table to yield a curl level in block 160. This curl level has many uses, for example, with the curl level detection scheme of the present invention being used in a duplex tray, the signal from block 160 which indicates the amount of curl in the sheet is sent to microprocessor 88 of FIG. 2 which in turn signals the fuser of the machine to decrease the heat used in fixing images to the sheet since the heat from the fuser could have contributed to the level of curl in the sheet when the sheet passed through the fuser for the fusing of the first side image.

Figure 2:
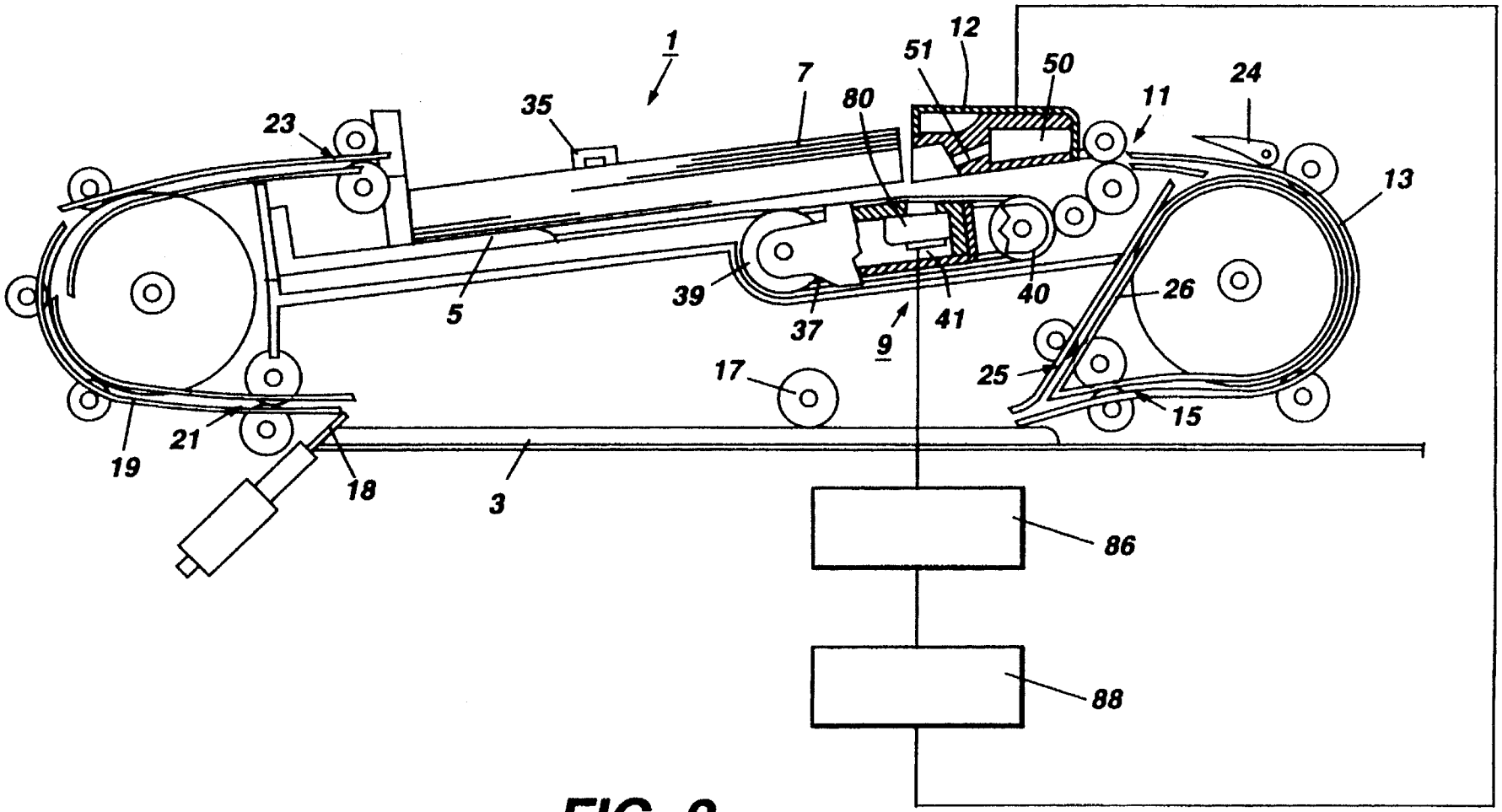
FIG. 2 is a cross sectional side view of an exemplary sheet separator-feeder employing the present invention.

Referring now particularly to FIG. 2, there is illustrated an exemplary automatic sheet separator-feeder for installation over the exposure platen 3 of a conventional xerographic reproduction machine, however, the principle of this invention and document handler 1 could also be used as a copy sheet feeding apparatus or duplex tray feeder with obvious modifications. This is merely one example of a document handler with which the exemplary sheet separator-feeder improvements of the present invention may be combined. The document handler 1 is provided with a document tray 5 which will be described in greater detail later, adapted for supporting a stacked set of documents 7. A vacuum belt corrugating feeling mechanism 9 is located below the front or forward area of the document tray for acquiring and corrugating the bottom document sheet in the stack and for feeding out that document sheet to take-away roll pair 11 through document guides 13 to a feed-roll pair 15 and under platen roll 17 onto the platen of the copy machine for reproduction. A retractable registration edge 18 is provided here to register the lead edge of the document fed onto the platen. Following exposure of the document, the edge 18 is retracted by suitable means such as solenoid and that document is fed off the platen by roll 17 onto guide 19 and feed-roll pair 21 and returned back to the top of the document stack through a feed-roll pair 23. Gross restacking lateral realignment is provided by a edge guide (not shown) resettable to a standard sheet site distance from an opposing fixed edge guide.

In the event it is desired to present the opposite side of a document for exposure, the document is fed from the stack 7 through guides 13 until the trail edge passes document diverter 24. Document diverter 24 is then rotated counterclockwise, i.e., into the document sheet path. The document direction is reversed and the document is diverted by diverter 24 through guides 26 and feed-roll pair 25 onto the platen 3.

The document handler 1 is also provided with a sheet separator finger 35 as is well known in the art, to sense and indicate the documents to be fed versus those documents returned to the document handler, i.e., to count each set circulated. Upon removal (feed out) of the last document from beneath sheet separator finger 35, the finger drops through a slot provided in the tray 5 to actuate a suitable sensor indicating that the last document in the set has been removed from the tray. The finger 35 is then automatically rotated in a clockwise direction or otherwise lifted to again come to rest on top of all the documents in the stack 7, for the start of the next circulation of document set 7.

Figure 3:
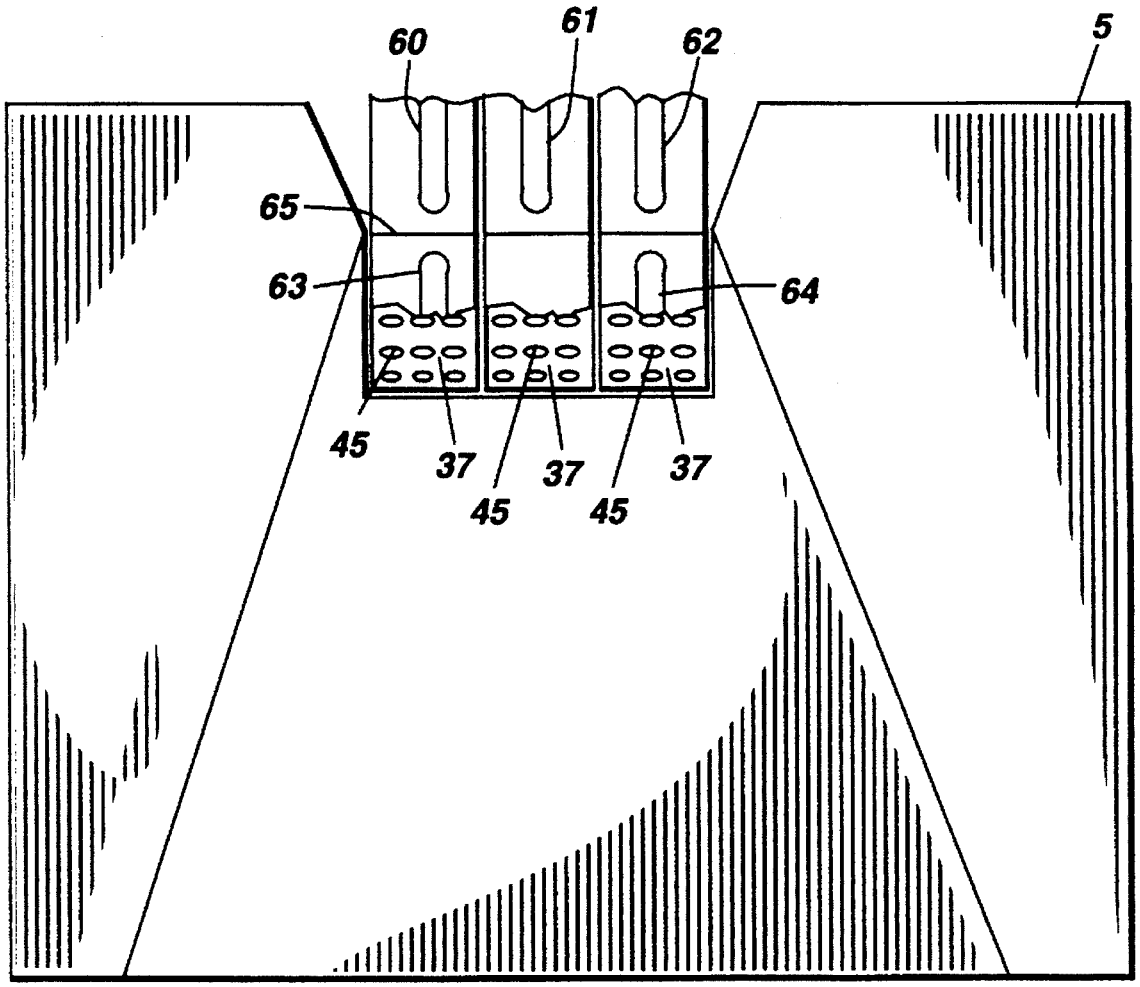
FIG. 3 is a plan view of the sheet separator-feeder showing the sheet stacking and holed belts surrounding a vacuum plenum.

Referring more particularly to FIGS. 2 and 3, and the document sheet separator-feeder 9, there is disclosed a plurality of feed belts 37 supported for movement on feed belt rolls, 39 and 40. Spaced within the run of the belts 37 there is provided a vacuum plenum 41 having a support plate and openings therein adapted for cooperation with perforations 45 of about 3 mm in the belts 37 to provide a vacuum for pulling the bottom document in the document stack onto the belts 37. The plenum 41 is bi-level sloped and provided with raised portions 60–64 that are below the belts 37 so that upon capture of the bottom document in the stack against the belts a corrugation will be developed in the sheet thereby enhancing its separation from the rest of the stack. This increased separation is due to the corrugation gaps placed in the sheet that reduce the vacuum pressure levels between the sheets due to porosity in the first (bottom) sheet and provide for entry of the separating air flow from the air knife 12.

The air knife 12 is comprised of a pressurized air plenum 50 having a plurality of separated air orifices 51 to inject air between the bottommost document pulled down against the feed belts and the documents in the stack thereabove to provide a air cushion or bearing between the stack and the bottom document to minimize the force needed for removing the bottom document from the stack.

By suitable valving and controls, it is also desirable to provide a delay between the time the vacuum is applied to pull the document onto the feed belts and the start up of the feed belts, to assure that the bottom document is captured on the belts before belt movement commences and to allow time for the air knife to separate the bottom sheet from any sheets that were pulled down with it.

Turning now to the present invention more particularly, present vacuum corrugation feeders sometimes have difficulties feeding stressed or curled sheets with the consequence that sheets do not reach particular subsystems within required time spans. An answer to this problem is shown in FIG. 1 and includes a conventional low cost vacuum switch 80 placed within vacuum transport plenum 41 that enhances performance of the feeder through closed loop air system control as described herein below. Switch 80 is a commercially available pressure switch which is diaphragm actuated and can be set to open or close an electrical control circuit at a given pressure (or vacuum) level. It can be installed either directly in the vacuum plenum as shown or in the duct which connects the plenum to the blower, as desired. The switch will detect any significant rise in vacuum and changes state at a preset vacuum level when the bottommost non-stressed sheet in the document stack 7 is pulled onto the perforated belts 37 that surround the vacuum plenum 41, thus sealing the air system and creating the characteristic closed port pressure. The degree of curl whether upcurl or downcurl is determined by measuring the time it takes to acquire a sheet to belts 37. A conventional digital control circuit 86 senses the change of state which takes place in the vacuum switch and feeds a signal to the machine's microprocessor 88. The microprocessor in turn sends a signal to air knife 12 which reacts to adjust the air pressure of the air knife to increase the flow of air through nozzles 51 sufficient to compensate for the particular stress level of the sheets.

Figure 4:
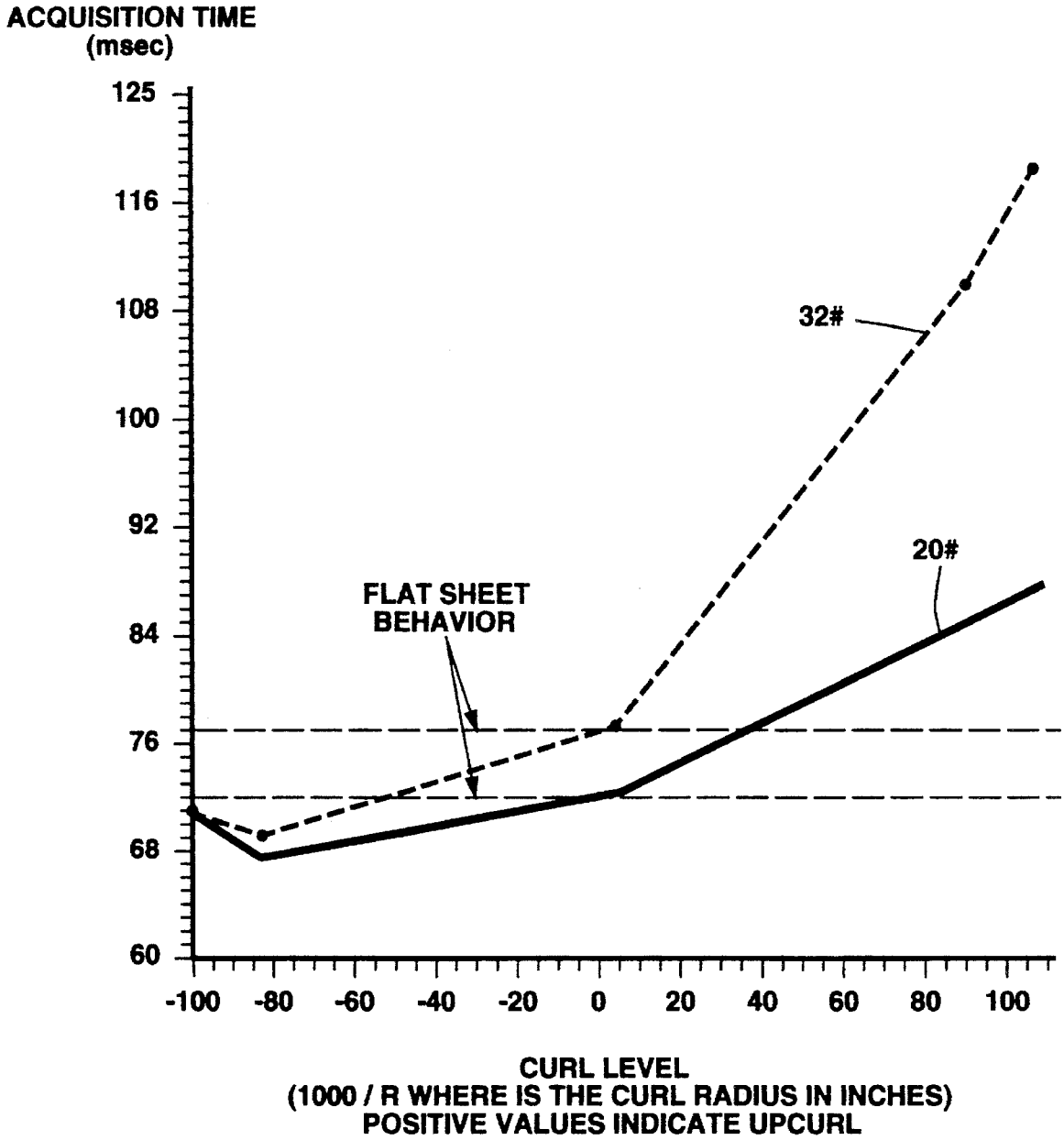
FIG. 4 is a chart showing sheet acquisition sensing times for different curl levels in accordance with the present invention.

Studies have shown a distinct correlation between the curl level present in a sheet and the time required to acquire the sheet. For example, in FIG. 4, the chart shows a preferential sensitivity to upcurl, part of which is inherent due to interactions with the air knife. The characteristic response exhibits sufficient sensitivity suitable for microprocessor control. The apparent overlap which can be seen, for example, in the acquisition time for flat 32 pound paper and a 20 pound paper with a curl radius of 33 inches (1000÷30) requires that the basis weight be known independently. This is enabled through combining the basis weight input either from a basis weight sensing scheme as shown in U.S. Pat. No. 5,138,178 which is incorporated herein by reference or through direct input by the operator, with the acquisition time input that the curl level may be determined with absolute confidence. Although lightweight sheets show relatively little change in acquisition time as a function of curl, this is not viewed as problem, since the curl level of lightweight sheets is generally seen to be of little consequence in setting machine parameters.

In conclusion, a curl detection system has been disclosed that uses the time needed to acquire a curled sheet by a bottom vacuum corrugation feeder to detect the degree of sheet curl for actions to be taken for reliable sheet handling. The acquisition time by the vacuum feeder is measured by a low cost pressure switch, in conjunction with a digital control circuit, determines the degree of vacuum behind perforations in feed belts that surround a vacuum plenum and signals a microprocessor to adjust various parameters, such as, timing, airflow, and velocity to compensate for the detected levels of curl.

It is, therefore, evident that there has been provided in accordance with the present invention a nip sheet sensing scheme has been disclosed which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A bottom sheet separator-feeder for separating and forwarding sheets seriatim from the bottom of a stack of sheets to be fed including curled sheets, comprising: a stacking tray having a surface for supporting a stack of sheets to be fed; air knife means positioned opposite the sheet stack and adapted to separate the bottommost sheet in the stack from the remainder of the stack; a plurality of apertured endless vacuum feed belts extending through at least the front end of said sheet stacking tray for acquiring and advancing the bottom sheet of the stack; said plurality of apertured endless vacuum feed belts extending across a vacuum chamber that includes a bi-level support plate for supporting said belts having vacuum ports therein for applying a negative pressure at the back of and through said belts; said support plate having a plurality of corrugation means for corrugating the bottommost sheet in the stack extending along a sloped bi-level portion of said support plate; and an arrangement for detecting the level of curl in the sheets and adjusting the air pressure of the air knife against the stack based on the degree of curl detected, said arrangement including a vacuum switch positioned within said vacuum chamber and adapted to change state at a preset vacuum level due to a sheet being pulled against said vacuum chamber, digital control circuitry:for sensing the change of state of said vacuum switch; and a microprocessor adapted to receive a signal from said control circuitry once said vacuum switch changes state and signal said air knife to increase air pressure toward the stack.

2. The separator-feeder of claim 1, wherein said corrugation means on said support plate of said vacuum chamber includes three raised members on a portion of said bi-level portion of said support plate with one of said raised members being positioned in the center of said support plate.

3. A bottom sheet separator-feeder for separating and forwarding sheets seriatim from the bottom of a stack of sheets to be fed including curled sheets, comprising: a stacking tray having a surface for supporting a stack of sheets to be fed; air knife means positioned opposite the sheet stack and adapted to separate the bottommost sheet in the stack from the remainder of the stack; a plurality of apertured endless vacuum feed belts extending through at least the front end of said sheet stacking tray for acquiring and advancing the bottom sheet of the stack; said plurality of apertured endless vacuum feed belts extending across a vacuum chamber that support said belts, said vacuum chamber having vacuum ports therein for applying a negative pressure at the back of and through said belts; and an arrangement for detecting the level of curl in the sheets and adjusting the air pressure of the air knife against the stack based on the degree of curl detected, said arrangement including a vacuum switch positioned with, in said vacuum chamber and adapted to change state at a preset vacuum level due to a sheet being pulled against said vacuum chamber, digital control circuitry for sensing the change of state of said vacuum switch; and a microprocessor adapted to receive a signal from said control circuitry once said vacuum switch changes state and signal said air knife to increase air pressure toward the stack.

4. The separator-feeder of claim 1, wherein said corrugation means on said support plate of said vacuum chamber includes three raised members on a portion of said bi-level portion of said support plate with one of said raised members being positioned in the center of said support plate.

5. In a bottom sheet separator-feeder for separating and forwarding sheets seriatim from the bottom of a stack of sheets to be fed, said bottom sheet separator-feeder including a stacking tray having a surface for supporting a stack of sheets to be fed, air knife means positioned opposite the sheet stack and adapted to separate the bottommost sheet in the stack from the remainder of the stack, a plurality of apertured endless vacuum feed belts extending through at least the front end of said sheet stacking tray for acquiring and advancing the bottom sheet of the stack, said plurality of apertured endless vacuum feed belts extending across a vacuum chamber that support said belts, said vacuum chamber having vacuum ports therein for applying a negative pressure at the back of and through said belts, the improvement for feeding curled sheets, comprising: and an arrangement for detecting the level of curl in the sheets and adjusting the air pressure of said air knife against the stack based on the degree of curl detected, said arrangement including a vacuum switch positioned within said vacuum chamber and adapted to change state at a preset vacuum level due to a sheet being pulled against said vacuum chamber, digital control circuitry for sensing the change of state of said vacuum switch; and a microprocessor adapted to receive a signal from said control circuitry once said vacuum switch changes state and signal said air knife to increase air pressure toward the stack.

6. A system for determining the amount of upcurl or downcurl in sheets individually from a stack, comprising:

a vacuum feeder having a vacuum plenum for drawing a sheet from the stack to said vacuum plenum for feeding along a predetermined path;

a vacuum switch positioned within said vacuum plenum and adapted to change state at a preset vacuum level due to a sheet being pulled against said vacuum plenum;

digital control circuitry for sensing the change of state of said vacuum switch;

a microprocessor adapted to receive a signal from said control circuitry once said vacuum switch changes state and determine the amount of curl in the sheet; and an air knife for separating individual sheets from the stack and wherein said microprocessor is adapted to receive a signal from said control circuitry once said vacuum switch changes state and signal said air knife to increase or decrease air pressure toward the stack to compensate for the particular curl in the sheet.

7. A system for determining the amount of upcurl or downcurl in sheets individually from a stack, comprising:

a vacuum feeder having a vacuum plenum for drawing a sheet from the stack to said vacuum plenum for feeding along a predetermined path;

a vacuum switch positioned within said vacuum plenum and adapted to change state at a preset vacuum level due to a sheet being pulled against said vacuum plenum;

digital control circuitry for sensing the change of state of said vacuum switch;

a microprocessor adapted to receive a signal from said control circuitry once said vacuum switch changes state and determine the amount of curl in the sheet; and a duplex tray and a fuser and wherein said microprocessor is adapted to signal said fuser to decrease the heat level of said fuser based on the amount of curl in the sheet fed from said duplex tray.

8. A method of determining the curl level in sheets fed from a vacuum feeder that attracts the sheets individually to a vacuum plenum, comprising the steps of:

actuating the vacuum feeder to feed sheets individually from the stack;

simultaneously starting a timer with the actuation of the vacuum feeder;

actuating a vacuum pressure switch upon once a sheet is captured by the vacuum plenum;

determining the time lapse between actuating the vacuum feeder and actuation of the vacuum pressure switch;

determining the basis weight of the sheets in the stack;

providing a lookup table of curl levels of sheets; and determining the curl level in the sheet from the lookup table based on the basis weight of the sheet and the time lapse between actuating the vacuum feeder and actuation of the vacuum pressure switch.

9. A system for determining the amount of upcurl or downcurl in sheets individually from a stack, comprising:

a vacuum feeder having a vacuum plenum for drawing a sheet from the stack to said vacuum plenum for feeding along a predetermined path;

a vacuum switch positioned within said vacuum plenum and adapted to change state at a preset vacuum level due to a sheet being pulled against said vacuum plenum;

a timer for measuring the acquisition time for capture of the sheet through actuation of said vacuum switch; and a microprocessor including a lookup table having the basis weights of a given range of sheets and adapted to receive a signal from said timer once said vacuum switch changes state and determine the amount of curl in the sheet based on the basis weight of the sheet and time of vacuum feeder acquisition of the sheet.

* * * * *